US007120516B2

(12) United States Patent
Hagino et al.

(10) Patent No.: US 7,120,516 B2
(45) Date of Patent: Oct. 10, 2006

(54) EMBROIDERING DEVICE

(75) Inventors: Seiichiro Hagino, Chiryu (JP); Mari Takagi, Nagoya (JP); Katsuhiko Kiwada, Nagoya (JP)

(73) Assignee: Aisin Seiki Kaushiki Kaisha, Kariya (JP)

( * ) Notice: Subject to any disclaimer, the term of this patent is extended or adjusted under 35 U.S.C. 154(b) by 283 days.

(21) Appl. No.: 10/637,501

(22) Filed: Aug. 11, 2003

(65) Prior Publication Data

US 2005/0229829 A1 Oct. 20, 2005

(30) Foreign Application Priority Data

Aug. 9, 2002 (JP) ..... 2002-233591

(51) Int. Cl.
*D05G 5/02* (2006.01)

(52) U.S. Cl. ..... 700/138; 112/102.5

(58) Field of Classification Search ..... 112/102.5, 112/155, 470.06, 475.19, 163, 167, 164, 165, 112/166; 700/138
See application file for complete search history.

(56) References Cited

U.S. PATENT DOCUMENTS 4,851,753 A * 7/1989 Hamilton ..... 318/609
5,904,109 A * 5/1999 Asano ..... 112/102.5
5,996,518 A * 12/1999 Tomita ..... 112/102.5
6,012,402 A * 1/2000 Sekine ..... 112/102.5

FOREIGN PATENT DOCUMENTS

JP 6-240557 8/1994

* cited by examiner

*Primary Examiner*—Danny Worrell
(74) *Attorney, Agent, or Firm*—Oblon, Spivak, McClelland, Maier & Neustadt, P.C.

(57) ABSTRACT

An embroidering device includes plural needles for embroidering plural patterns and an operating portion having a display. The patterns are embroidered by selectively actuating the needles in accordance with a command from the operating portion, the display of the operating portion indicates codes of the needles to be used for embroidering the patterns in sequence, and the code of the needle being in actuation is emphatically indicated on the display. Indication corresponding to temporary stop of the actuation can be indicated between the codes if the actuation needs to be temporarily stopped.

7 Claims, 5 Drawing Sheets

EMBROIDERING DEVICE

CROSS REFERENCE TO RELATED APPLICATIONS

The application is based on and claims priority under 35 U.S.C. §119 with respect to a Japanese Patent Application 2002-233591, filed on Aug. 9, 2002, the entire content of which is incorporated herein by reference.

FIELD OF THE INVENTION

This invention generally relates to an embroidering device. More particularly, this invention pertains to an embroidering device which includes plural needles and embroiders plural patterns by selectively actuating the needles in accordance with a command from an operating portion.

BACKGROUND OF THE INVENTION

For example, in a known embroidering device, codes corresponding to needles to be used for embroidering are indicated on a display of an operating portion in accordance with an operating order. Then each needle is automatically actuated in sequence based on the operating order. The code of the needle being in actuation is emphatically indicated by using a different color so that the needle being in the actuation can be easily recognized.

However, in the foregoing embroidering device, though the needle being in the actuation can be easily recognized, it is difficult to embroider a complex sewing pattern. That is, if the embroidering is further performed after overlapping an upper cloth on a lower cloth on which a predetermined sewing pattern is embroidered, operation of the embroidering device need to be temporarily stopped before a certain needle is actuated. In this case, a code of the certain needle has to be memorized, which is troublesom.

The present invention therefore seeks to provide an embroidering device in which temporary stop of operation of the embroldering device can be easily recognized when the operation of the embroidering device need to be temporarily stopped.

SUMMARY OF THE INVENTION

According to an aspect of the present invention, an embroidering device includes plural needles for embroidering plural patterns and an operating portion having a display. The patterns are embroidered by selectively actuating the needles in accordance with a command from the operating portion, the display of the operating portion indicates codes of the needles to be used for embroidering the patterns in sequence, and the code of the needle being in actuation is emphatically indicated on the display indication corresponding to temporary stop of the actuation can be indicated between the codes if the actuation needs to be temporarily stopped.

BRIEF DESCRIPTION OF THE DRAWING FIGURES

The foregoing and additional features and characteristics of the present invention will become more apparent from the following detailed description considered with reference to the accompanying drawing figures wherein:

FIG. 5(*b*) is pulse of voltage applied to the X-motor and Y-motor as the embroidery frame is manually moved in the present invention;

FIG. 5(*c*) is conventional pulse of voltage applied to the X-motor and the Y-motor as the embroidery frame is manually moved;

DETAILED DESCRIPTION OF THE INVENTION

Hereinafter, an embodiment of the present invention will be described with reference to FIGS. 1–7.

Figure 1:
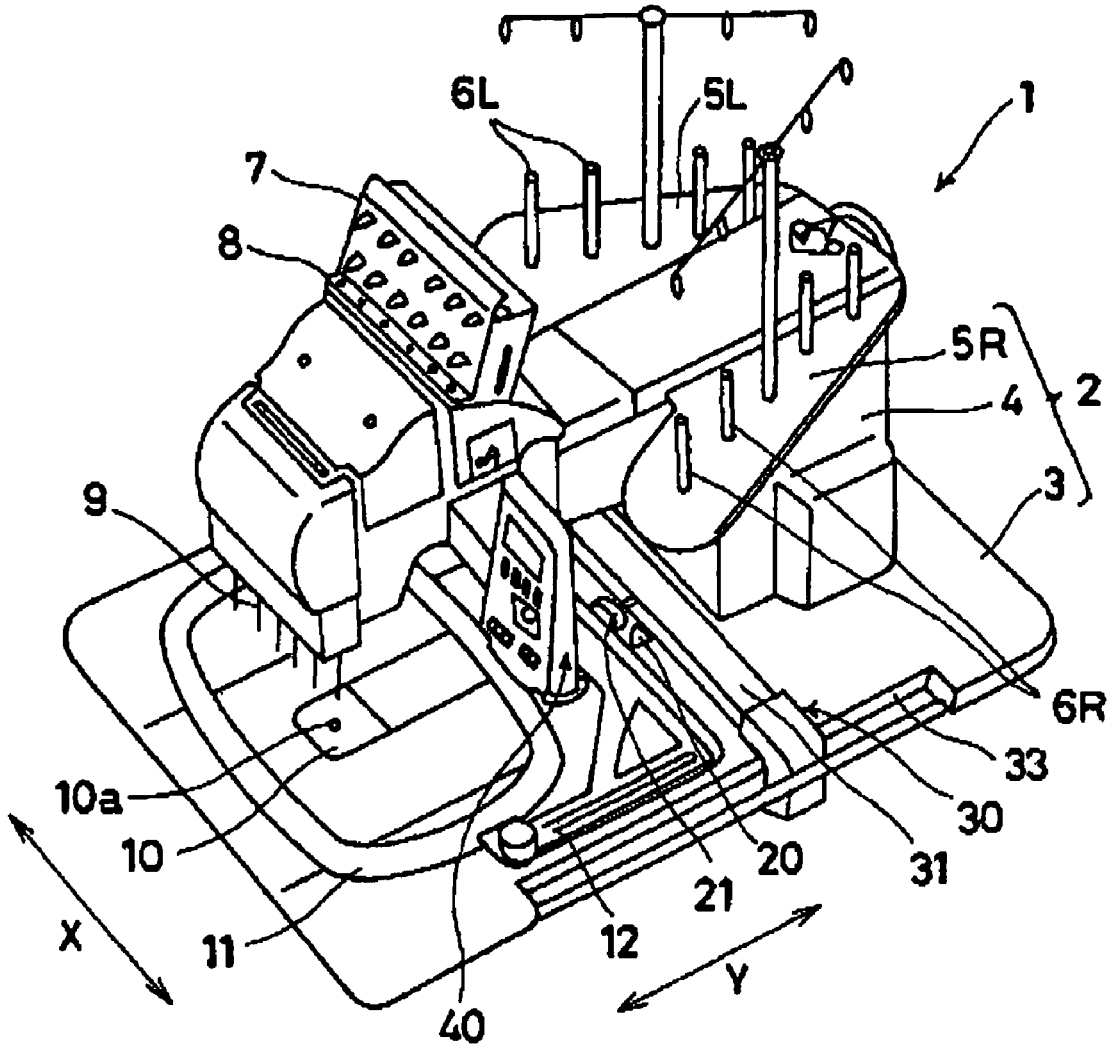
FIG. 1 is a perspective view of an embroidering device according to an embodiment of the present invention.

FIG. 1 shows a schematic view of an embroidering device 1 according to an embodiment of the present invention. A body 2 of the embroidering device 1 includes a table 3 and an arm 4. The arm 4 extends upward from an upper surface of the table 3. The arm 4 includes two bobbin tables 5R and 5L where bobbins are set. The bobbin table 5R includes four bobbin holders 8R, and the bobbin table 5L includes four bobbin holders 6L as same with the bobbin table 5R. That is, eight bobbins can be set to the bobbin tables 5R and 5L through the bobbin holders 6R and 6L. An embroidery thread from each bobbin is put through an embroidery needle 9 through a tension device 7 and a guide 8. When embroidery is performed, the one embroidery needle 9 is positioned directly above a center hole 10*a* of a needle plate 10 after one of the embroidery needles 9 to be used is selected by a needle selector. Then the embroidery needle 9 having been selected is actuated by a driving unit (not shown) provided in the arm 4, embroidery is performed. With reference to an embroidery unit 71 (shown in FIG. 4) which actuates the embroidery needle 9, a conventional device is applied as the embroidery unit 71 in this embodiment, and therefore detailed explanation is omitted.

An embroidery frame 11 is provided on the upper surface of the table 3 so as to be horizontally movable on the table 3 by a X-driving unit 20 including a movable member 21 and a Y-driving unit 30 including a movable bar 31. When a X-motor 22 (shown in FIG. 4) is actuated, the movable member 21 of the X-driving unit 20 slides along a groove formed on a lateral side of the movable bar 31, and the embroidery frame 11 connected to the movable member 21 through a holding member 12 is moved along X-direction (shown in FIG. 1). The movable bar 31 is provided on the table 3 with both ends of the movable bar 31 being inserted in grooves 33 formed on both lateral sides of the table 3. When a Y-motor 32 (shown in FIG. 4) is actuated, the movable bar 31 is moved along Y-direction (shown in FIG. 1), and then the embroidery frame 11 is moved along the Y-direction together with the movable member 21 and the holding member 12.

Next, explanation concerning an operating portion 40 of the embroidering device 1 will be provided below with reference to FIG. 2. The operating portion 40 is fixed to a lateral side of the arm 4 and the upper surface of the table 3. A display 41 and various types of key switches are provided on a panel of the operating portion 40. The key switches include three function keys 42, a numeric keypad 43, a data set key 44, a power key 46, an offset key. 46, a trace key 47, and a zero return key 48 which returns the embroidery frame 11 to a starting point. The key switches further include a forward key 49, a backward key 50, a start key 51, a stop key 52, a color change key 53, a thread cut key 54, a sensor key 55, an alarm clear key 56, an embroidering speed key 57, and an emergency stop key 58. An embroidery frame key 60 is provided approximately at the middle of the panel of the operating portion 40. Further, a set key 90 and a cancel key 92 are provided on lower part of the panel.

Figure 2:
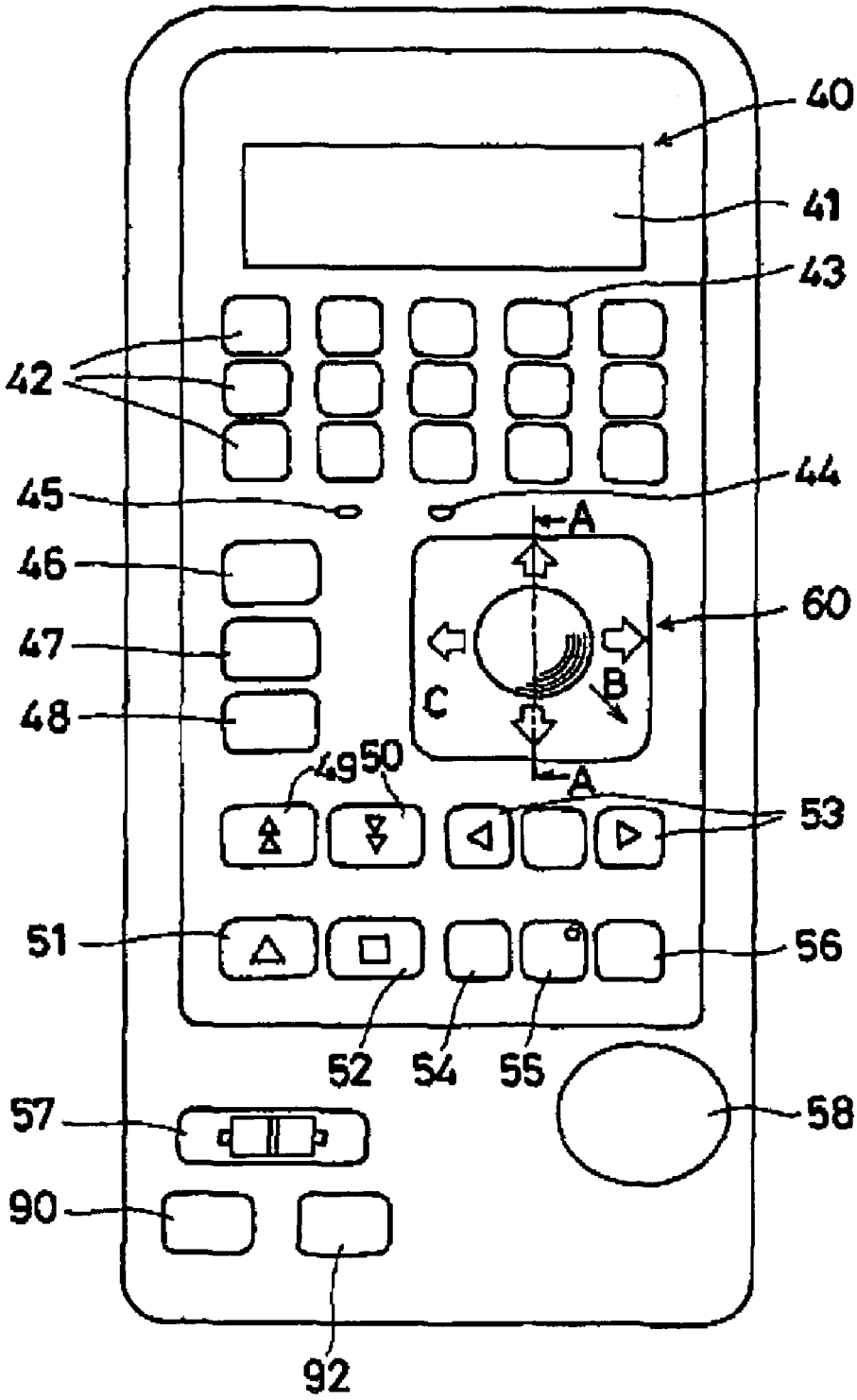
FIG. 2 is an operating portion of the embroidering device according to an embodiment of the present invention.
Figure 3:
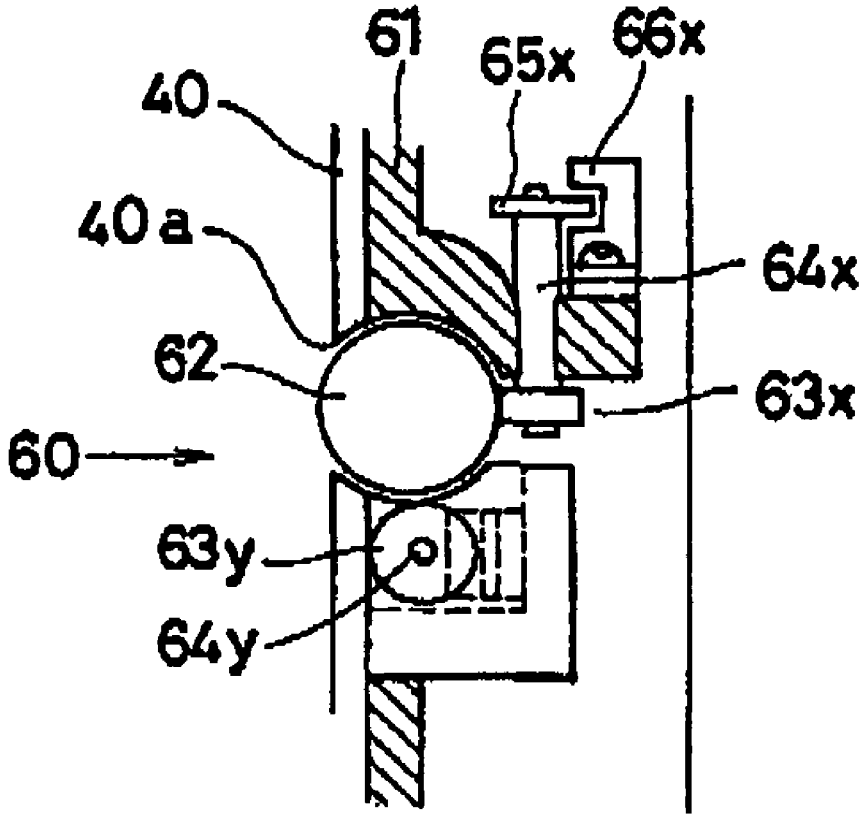
FIG. 3 is a cross sectional view taken along the line A—A of FIG. 2.

FIG. 3 is a cross sectional view of the embroidery frame key 60 taken along the line A—A of FIG. 2. As shown in FIG. 3, ball-shaped space is formed inside of the operating portion 40 by a holding member 61 provided under the operating portion 40, and a ball portion 62 is rotatably provided in the ball-shaped space so that an upper end of the ball portion 62 can be seen through a hole 40*a* formed on the operating portion 40.

The ball portion 62 is in contact with an X-roller 66*x*. The X-roller 63*x* rotates in response to rotation of the ball portion 62. The X-roller 63*x* is provided on one end of a shaft 64*x* rotatably supported by the holding member 61. A rotary encoder 65*x* including a primary slit 65*x*1 (shown in FIG. 4) and a secondary slit 65*x*2 (shown in FIG. 4) is provided on the other end of the shaft 64*x*. Optical signals passing through the primary slit 65*x*1 and the secondary slit 65*x*2 have difference in phase by 90 degrees (a quarter cycle) each other. Further, the holding member 81 includes an X-sensor 66*x* so that the X-sensor 66*x* can be close to the rotary encoder 65*x*. The X-sensor 66*x* Includes a primary X-sensor 66*x*1 (shown in FIG. 4) and a secondary X-sensor 66*x*2 (shown in FIG. 4). The primary X-sensor 66*x*1 detects the optical signal from the primary slit 65*x*1 of the rotary encoder 65*x*, and the secondary X-sensor 68*x*2 detects the optical signal from the secondary slit 65*x*2 of the rotary encoder 65*x*. The optical signals passing through the primary slit 65*x*1 and the secondary slit 65*x*2 are detected by the primary X-sensor 66*x*1 and the secondary X-sensor 66*x*2, and then the primary X-sensor 66*x*1 and the secondary X-sensor 66*x*2 output sensor signals to a microcomputer 70. The microcomputer 70 can recognize rotational direction and amount of the rotary encoder 65*x* and the X-roller 63*x* in response to the sensor signals from the primary X-sensor 66*x*1 and the secondary X-sensor 66*x*2 having difference in the phase each other.

Additionally, the ball portion 62 is in contact with a Y-roller 63*y*. The Y-roller 63*y* rotates in response to rotation of the ball portion 62. The Y-roller 63*y* is provided on one end of a shaft 64*y* rotatably supported by the holding member 61, and a rotary encoder 65*y* (shown in FIG. 4) is provided on the other end of the shaft 64*y*. The rotary encoder 65*y* includes a primary slit 65*y*1 and a secondary slit 65*y*2 as same with the rotary encoder 65*x*. Optical signals passing through the primary silt 65*y*1 and the secondary slit 65*y*2 have difference in phase each other. The optical signals from the primary slit 65*y*1 and the secondary slit 65*y*2 are detected by a primary Y-sensor 66*y*1 (shown in FIG. 4) and a secondary Y-sensor 66*y*2 (shown in FIG. 4) of a Y-sensor 66*y* (shown in FIG. 4) provided so as to be close to the rotary encoder 65*y*. Then these Y-sensors 66*y*1 and 66*y*2 output sensor signals to the microcomputer 70. The microcomputer 70 can recognize rotational direction and amount of the rotary encoder 65*y* and the Y-roller 63*y*.

Figure 4:
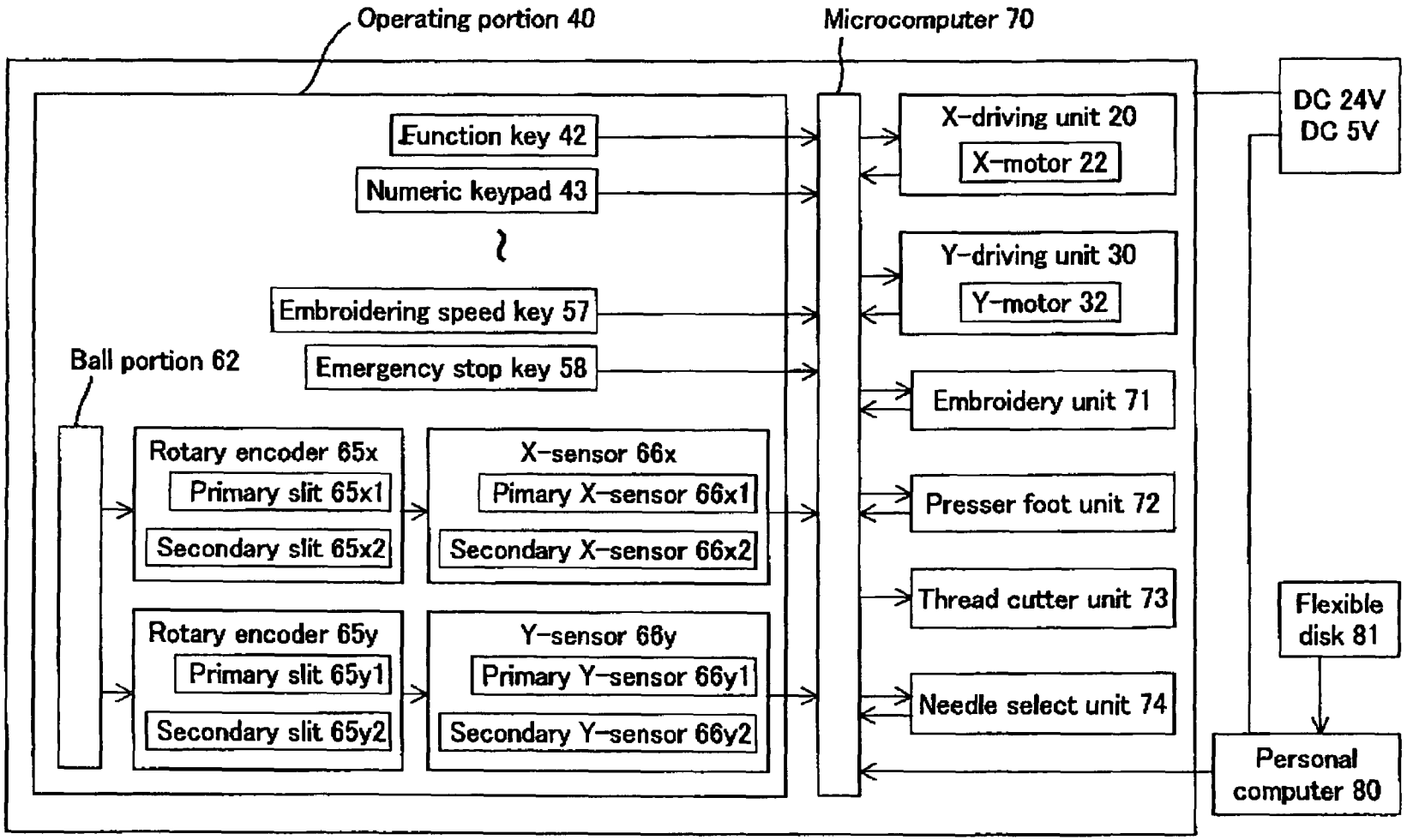
FIG. 4 is a block diagram showing an electrical structure of the embroidering device.

Next, explanation concerning an electrical structure of the embroidering device 1 will be provided below with reference to FIG. 4. In the embodiment, a command from the operating portion 40 is inputted to the microcomputer 70. The microcomputer 70 is connected to the X-driving unit 20 and the Y-driving unit 30 horizontally moving the embroidery frame 11, the above-described embroidery unit 71, a presser foot unit 72, a thread cutter unit 73, and a needle select unit 74 in addition to the operating portion 40. Further, a personal computer 80 is connected to the microcomputer 70. The personal computer 80 reads out an embroidery data inputted to a flexible disk 81, and then outputs the embroidery data to the microcomputer 70. According to a keyboard of the personal computer 80, moving distance of the embroidery frame 11 corresponding to a certain amount of the rotation of the ball portion 62 and the embroidery data such as thread density, layout, and conversion can be changed.

Figure 5:
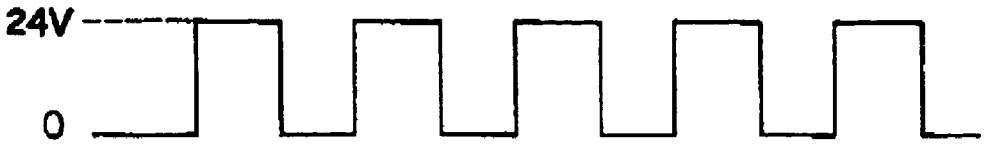
FIG. 5(*a*) is pulse of voltage applied to an X-motor and a Y-motor as the embroidery frame is automatically moved in accordance with an embroidery data.
Figure 5:
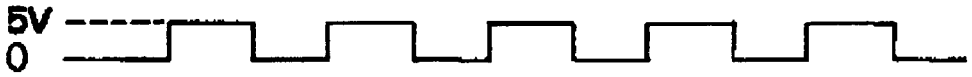
Figure 5:
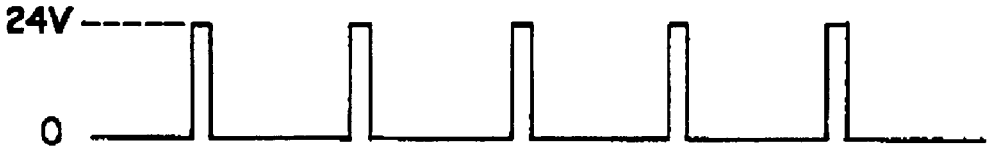

In the embodiment, voltage applied to the X-motor 22 and the Y-motor 32 as the embroidery frame 11 is moved in response to the embroidery data for embroidering an embroidery pattern is different from voltage as the embroidery frame 11 is moved in response to operation of the ball portion 62. When the embroidery frame is automatically moved in response to the embroidery data for embroidering the embroidery pattern, as shown in FIG. 5(*a*), voltage of 24V is applied to the X-motor 22 and the Y-motor 32, and then the embroidery frame 11 is moved quickly. On one hand, when the embroidery frame 11 is manually moved in response to the operation of the ball portion 62, as shown in FIG. 5(*b*), low voltage of 5V is applied, and then the embroidery frame 11 is moved slowly. In the embodiment, the embroidery frame 11 can be moved slowly by applying the low voltage, that is, pulse with wide length can be given to the X-motor 22 and the Y-motor 32, and then variation of speed as the embroidery frame 11 is moved can be reduced. Further, the voltage of 5V is supplied by power source for the microcomputer 70 of the embroidering device 1, transformer does not need to be newly provided, and then the low voltage can be easily supplied. For example, if the embroidery frame 11 is moved slowly by applying voltage with narrow pulse length shown in FIG. 5(*c*), the embroidery frame 11 may suddenly stop or start to move when movement of the embroidery frame 11 is prevented for some reason. Further, this movement of the embroidery frame 11 may generate noise, which is undesirable.

Next, operation of the embroidering device 1 will be explained below. When the power source is turned on, all memories of the microcomputer 70 are initialized. The embroidery frame 11 can be moved by operating the ball portion 62 of the operating portion 40. For example, the embroidery frame 11 is moved to the left when the ball portion 82 is rotated to the left ("C" direction in FIG. 2); in this case, since the ball portion 62 rotates only in the X-direction, only the X-roller 63*x* rotates, and then the Y-roller 63*y* does not rotate. Thus, the microcomputer 70 recognizes only the movement of the embroidery frame 11 concerning the X-direction by signals from the rotary encoder 65*x* and the X-sensor 66*x*. The microcomputer 70 determines direction to move the embroidery frame 11 based on the signals from the X-sensor 66*x* having the difference in the phase and recognizes the moving distance of the embroidery frame 11 by counting the signals and then actuates the X-motor 22 of the X-driving unit 20. Consequently, the movable member 21 slides to the left along the groove formed on the lateral side of the movable bar 31, and the embroidery frame 11 is moved to the left.

On one hand, when the ball portion 62 is rotated to the lower right ("B" direction in FIG. 2), the embroidery frame 11 is moved to the lower right. In this case, the ball portion 62 rotates in combined direction concerning the X and Y-directions, then the X-roller 63*x* and the Y-roller 63*y* respectively rotate in response to the rotation of the ball portion 62 concerning the X-direction and the Y-direction. Rotational direction and amount of the ball portion 62 concerning the X-direction are detected by the rotary encoder 65*x* and the X-sensor 66*x*, and rotational direction and amount of the ball portion 62 concerning the Y-direction are detected by the rotary encoder 85*y* and the Y-sensor 66*y*. In the microcomputer 70, direction to move the embroidery frame 11 and the moving distance of the embroidery frame 11 are determined based on the signals from the X and Y-sensor 66*x* and 66*y*, and then the microcomputer 70 concurrently actuates the X-motor 22 of the X-driving unit 20 and the Y-motor 32 of the Y-driving unit 30. The movable member 21 is moved to the right by the X-motor 22, and the movable bar 31 is moved downward by the Y-motor 32. Thus, the embroidery frame 11 moves to the lower right by combined movement concerning the X and Y-directions.

After setting the embroidery frame 11 to a position where embroldering is started, the embroidering of the embroidery pattern is performed with reference to the following procedure.

(1) Press the set key 90, and input a code "1" of the embroidery needle 9 corresponding to a first thread for embroldering a first embroidery pattern by using the numeric keypad 43.

(2) When a second thread needs to be used for embroidering a second embroidery pattern, input a code "2" of the embroidery needle 9 corresponding to the second thread by using the numeric keypad 43.

(3) When a third thread needs to be used for embroidering a third embroidery pattern, input a code "4" of the embroidery needle 9 corresponding to the third thread by using the numeric keypad 43.

(4) When all the codes of the embroidery needles 9 corresponding to the threads to be used for embroidering the embroidery pattern are inputted, press the set key 90.

Figure 6:
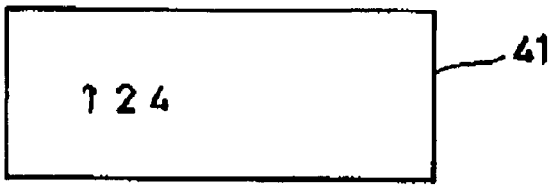
FIG. 6 is an example of indication indicated on a display of the operating portion.

When the foregoing procedure is performed, the display 41, as shown in FIG. 6, indicates "124".

After that, when the start key 61 is pressed, the embroidery unit 71 is actuated in accordance with an embroidery data. The embroidery frame 11 is moved by the X-driving unit 20 and the Y-driving unit 30 based on the embroidery data, and then three embroidery patterns are continuously embroidered by three embroidery needles 9 having the codes "1", "2", and "4". When the embroidery data corresponding to the end is inputted to the embroidery unit 71, the thread is cut by the thread cutter unit 73, and then the embroidering is ended.

Figure 7:
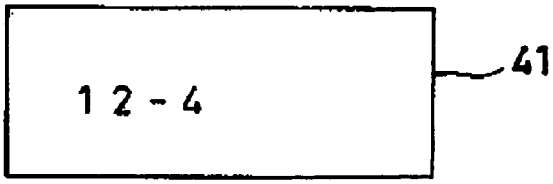
FIG. 7 is another example of indication indicated on the display of the operating portion.

If applique is performed by the embroidery needle 9 having the code "4" after the second embroidery pattern is embroidered by the embroidery needle 9 having the code "2" the operation of the embroidery unit 71 needs to be temporarily stopped after the second embroidery pattern is embroidered. In this case, when a mark "–" and the code "4" of the needle 9 corresponding to the third thread are inputted by using the numeric keypad 43 in the foregoing procedure (3), the display 41 indicates "12-4" as shown in FIG. 7. After that, when the start key 51 is pressed, the embroidery unit 71 is actuated in accordance with an embroidery data. The embroidery frame 11 is moved by the X-driving unit 20 and the Y-driving unit 30 based on the embroidery data, and then two embroidery patterns are continuously embroidered by two embroidery needles 9 having the codes "1" and "2". Then, the operation of the embroidery unit 71 is temporarily stopped when the mark is "–" is read out by the program. While the operation of the embroidery unit 71 is stopped, an upper cloth can be overlapped on a lower cloth. Then the operation of the embroidery unit 71 starts when the start key 51 is pressed once again, and the third embroidery pattern is subsequently embroidered by the embroidery needle 9 having the code "9".

In addition, with respect to indication on the display 41, the codes of the embroidery needles 9 being in actuation and the mark "–" as the embroidery unit 71 is in temporary stop are indicated with a red cursor.

According to the present invention, indication corresponding to temporary stop of embroidering can be indicated between codes of embroidery needles, and the temporary stop of the embroidering can be easily recognized by watching a display of an operating portion indicating the foregoing indication. Further, the temporary stop during the embroidering can be automatically performed by previously programming an embroidery data corresponding to the temporary stop.

The principles, preferred embodiments and mode of operation of the present invention have been described in the foregoing specification. However, the invention which is intended to be protected is not to be construed as limited to the particular embodiments disclosed. Further, the embodiments described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

We claim:

1. An embroidering device, comprising:

plural needles for embroidering plural patterns; and an operating portion having a display, wherein the patterns are embroidered by selectively actuating the needles in accordance with a command from the operating portion, the display of the operating portion indicates codes of the needles to be used for embroidering the patterns in sequence, and wherein the code of the needle being actuated is emphatically indicated on the display, and said display provides an indication corresponding to a temporary stop, with the temporary stop occurring between actuation of two needles, and wherein the indication is displayed at a location between two displayed codes corresponding to the two needles.

2. The embroidering device according to claim 1, wherein the operating portion further comprises:

a keypad which receives at least one needle code from a user.

3. The embroidering device according to claim 2, wherein the device includes an embroidery frame which can support at least one cloth, and wherein the frame is movable; and wherein the operating portion further comprises a frame movement input device which receives a command from the user to move the frame.

4. The embroidering device according to claim 3, wherein the frame movement input device includes a ball portion and a rotary sensor which measures movement of the ball portion by the user, wherein the frame is moved by an amount proportional to the movement of the ball portion by the user.

5. The embroidering device according to claim 1, wherein the device includes an embroidery frame which can support at least one cloth, and wherein the frame is movable; and wherein the operating portion further comprises a frame movement input device which receives a command from the user to move the frame.

6. The embroidering device according to claim 5, wherein the frame movement input device includes a ball portion and a rotary sensor which measures movement of the ball portion by the user, wherein the frame is moved by an amount proportional to the movement of the ball portion by the user.

7. The embroidering device according to claim 1, wherein the operating portion:

receives an embroidery pattern;

receives at least one code, each code corresponding to a respective embroidery needle;

receives at least one temporary stop command;

receives a first embroider start command;

starts the embroidering of the embroidery pattern using needles corresponding to the at least one code in response to the first embroider start command;

temporarily stops the embroidering based on the at least one temporary stop command;

receives a second embroider start command; and restarts embroidering the embroidery pattern in response to the second embroider start command.

* * * * *